US006380499B1

(12) United States Patent
Edwards

(10) Patent No.: US 6,380,499 B1
(45) Date of Patent: Apr. 30, 2002

(54) FLOAT SENSOR EMPLOYING REED SWITCH

(75) Inventor: Paul K. Edwards, Norwich (GB)

(73) Assignee: Breed Automotive Technology, Inc., Lakeland, FL (US)

( * ) Notice: Subject to any disclaimer, the term of this patent is extended or adjusted under 35 U.S.C. 154(b) by 0 days.

(21) Appl. No.: 09/419,275

(22) Filed: Oct. 15, 1999

(30) Foreign Application Priority Data

May 21, 1999 (GB) ..... 9911701

(51) Int. Cl.[7] ..... H01H 35/18
(52) U.S. Cl. ..... 200/84 C; 335/205
(58) Field of Search ..... 73/305–309, 314, 73/317, 322.5; 200/61.2, 61.21, 81.9 M, 84 R, 84 A, 84 B, 84 C; 335/205–207

(56) References Cited

U.S. PATENT DOCUMENTS

| | | | | | |
|---|---|---|---|---|---|
| 2,116,415 | A | | 5/1938 | Shenton | 200/84 |
| 2,851,566 | A | | 9/1958 | Fuller | 200/84 |
| 2,870,287 | A | | 1/1959 | Corbitt et al. | 200/87 |
| 3,679,867 | A | * | 7/1972 | Canter | 219/272 |
| 3,751,616 | A | | 8/1973 | Innes et al. | 200/84 C |
| 3,803,573 | A | | 4/1974 | Schonger | 340/261 |
| 4,091,365 | A | | 5/1978 | Allen | 340/243 |
| 4,139,750 | A | | 2/1979 | Rau | 200/84 R |
| 4,258,238 | A | | 3/1981 | Dombrowski et al. | 200/84 C |
| 4,259,975 | A | | 4/1981 | Kinsey et al. | 137/1 |
| 4,513,185 | A | | 4/1985 | Walters | 200/84 |
| 4,615,303 | A | * | 10/1986 | Sackett | 123/41.15 |
| 4,663,540 | A | | 5/1987 | Ferrante | 307/118 |
| 4,825,181 | A | * | 4/1989 | Nagano et al. | 335/205 |
| 4,883,928 | A | | 11/1989 | Umehara | 200/81.9 |
| 5,156,048 | A | * | 10/1992 | DeFigueiredo et al. | 73/308 |
| 5,233,322 | A | | 8/1993 | Posey | 335/151 |
| 5,239,285 | A | | 8/1993 | Rak | 340/623 |
| 5,426,271 | A | | 6/1995 | Clark et al. | 200/84 |
| 5,458,508 | A | * | 10/1995 | Sawada | 439/620 |
| 5,827,962 | A | | 10/1998 | Guenther et al. | 73/308 |
| 5,924,285 | A | * | 7/1999 | Chiba | 60/585 |
| 6,111,211 | A | * | 8/2000 | Dziedzic et al. | 200/61.2 |

FOREIGN PATENT DOCUMENTS

| | | | | |
|---|---|---|---|---|
| DE | 4115422 A1 | * | 11/1991 | H01H/36/02 |
| EP | 0518307 A | | 12/1992 | G01F/23/74 |
| FR | 2486644 | | 1/1982 | F28F/9/02 |
| FR | 2635868 | | 3/1990 | G01F/23/30 |
| GB | 1184223 | | 3/1970 | H01H/36/02 |
| GB | 2100515 A | | 12/1982 | H01H/11/00 |
| GB | 2162690 | | 2/1986 | H01H/36/02 |
| GB | 2217913 A | | 11/1989 | H01H/50/02 |
| GB | 2243953 A | | 11/1991 | H01H/36/00 |
| IT | 537286 | | 12/1955 | |

* cited by examiner

*Primary Examiner*—Michael Friedhofer
(74) *Attorney, Agent, or Firm*—Lonnie Drayer; Patrick Stiennon

(57) ABSTRACT

A reed switch in a solid plastic body is positioned by a clip adjacent to a fluid container. A change in fluid level opposite the reed switch moves a magnet connected to a float, turning the reed switch on or off. Glass filled polyester is injected into a die which surrounds the reed switch supported on electrical plug blades. The reed switch has high stiffness leads positioned on the blades, and is oriented within the mold so the injected plastic flows along the glass tube of the reed switch, minimizing stresses on the reed switch, which could result in the reed switch becoming crack and/or broken. The molded plastic body incorporates an integrally formed clip arm that functions to position and hold the plastic body onto a larger structure. The magnet and float may move in a tube, may pivot, or slide along rails in response to a change in fluid level.

9 Claims, 3 Drawing Sheets

FLOAT SENSOR EMPLOYING REED SWITCH

FIELD OF THE INVENTION

The present invention relates to liquid level sensors in general and to sensors employing reed switches in particular.

BACKGROUND OF THE INVENTION

Determining the amount or level of liquid in a tank is a problem of widespread importance. Applications range from fuel tanks, lubricating fluid tanks, and water level monitors within humidifiers, boilers, and dishwashers. Typically the concerns are the same: to reliably indicate when liquid rises to a preselected level or when a liquid falls below a preselected level. A common mechanical float sensor incorporates a buoyant float, which responds to a rise in the level of a liquid by pushing against a switch causing the switch to open or close.

Float sensors are typically a critical part of an apparatus, serving as part of the liquid control system in the apparatus. The flooding or running dry which results from the float sensor's failure can be costly or at least inconvenient. Float sensors employing electric switches face additional challenges. An electric switch submerged in or positioned near a liquid has inherent reliability problems. The liquid may be corrosive, may promote galvanic corrosion, or may form a varnish, which builds up on exposed surfaces and contacts resulting in the buildup of an insulating layer, which affects electrical parts.

Alternatively, the raising float may contain a magnet, which interacts with a reed switch causing it to open or close. Reed switches are widely used where an extremely reliable switch is required. Reed switches are reliable because the contacts that close the switch are located within a hermetically sealed glass envelope. A reed switch typically has two ferromagnetic reeds that extend from opposite ends of a sealed glass tube. The contacts are formed on opposed surfaces of the reeds which overlap and are spaced apart a small amount when no magnetic field is present. In the presence of a magnetic field the ferromagnetic reeds attract and are brought into engagement at the contact surfaces, thus closing a circuit between the ferromagnetic reeds.

Reed switches do have some limitations which flow from their advantages: namely the glass capsule which contains the ferromagnetic reeds is inherently subject to being broken, and a reed switch must be reliably positioned with respect to the actuation magnet in a cost affective manner.

What is needed are float sensors employing reed switches which are more reliable and more easily installed.

SUMMARY OF THE INVENTION

The float sensor of this invention employs a reed switch contained within a solid plastic body which is positioned by a clip adjacent to an impervious wall forming part of a fluid container. Addition or drainage of the fluid causes the fluid level within the fluid container to vary, opposite the reed switch, this in turn causes a float to move toward or away from the reed switch. This motion results in turning the reed switch on or off.

The plastic body is formed by injecting glass filled polyester into a die that surrounds a reed switch with two high stiffness leads that form part of a lead frame. The reed switch is oriented within the die so that when plastic is injected, it flows along the glass tube of the reed switch. This flow path minimizes the disturbance of the reed switch due to the plastic flow that could result in the reed switch becoming broken. The molded plastic body incorporates an integrally formed clip arm that functions to position and hold the plastic body onto a larger structure.

The reed switch may be actuated by a magnet mounted to a float, which is pivotally mounted by an arm on a structure. The arm has the magnet mounted between the float and a pivot. Motion of the float in response to fluid level changes results in movement of the magnet into and out of position with respect to a reed switch contained within a plastic body, to cause the reed switch to open and close with the motion of the magnet. The reed switch is mounted spaced from the float by an impervious wall that prevents moisture or liquids from contracting the plastic body.

An alternative means for reed switch actuation consists of a torpedo shape float contained within a cylindrical tube. The bottom of the tube has openings through which fluid can enter to raise the float and cause a magnet contained in the float to move relative to a reed switch within a plastic body, causing the reed switch to open or close. The float is separated from the plastic body by an impervious wall.

A further alternative reed switch actuation means consists of a float containing a magnet, which is constrained to move along opposed rails which capture the float. The float is again separated from a plastic body containing a reed switch by an impervious wall. Motion of the float due to liquid level changes causes the reed switch to change the activation state.

It is a feature of the present invention to provide an improved packaging for a reed switch.

It is a further feature of the present invention to provide float sensors that are more reliable, more easily assembled, and low cost.

It is another feature of the present invention to provide a method of encapsulating a reed switch.

Further features and advantages of the invention will be apparent from the following detailed description when taken in conjunction with the accompanying drawings.

DETAILED DESCRIPTION OF THE INVENTION

Figure 1:
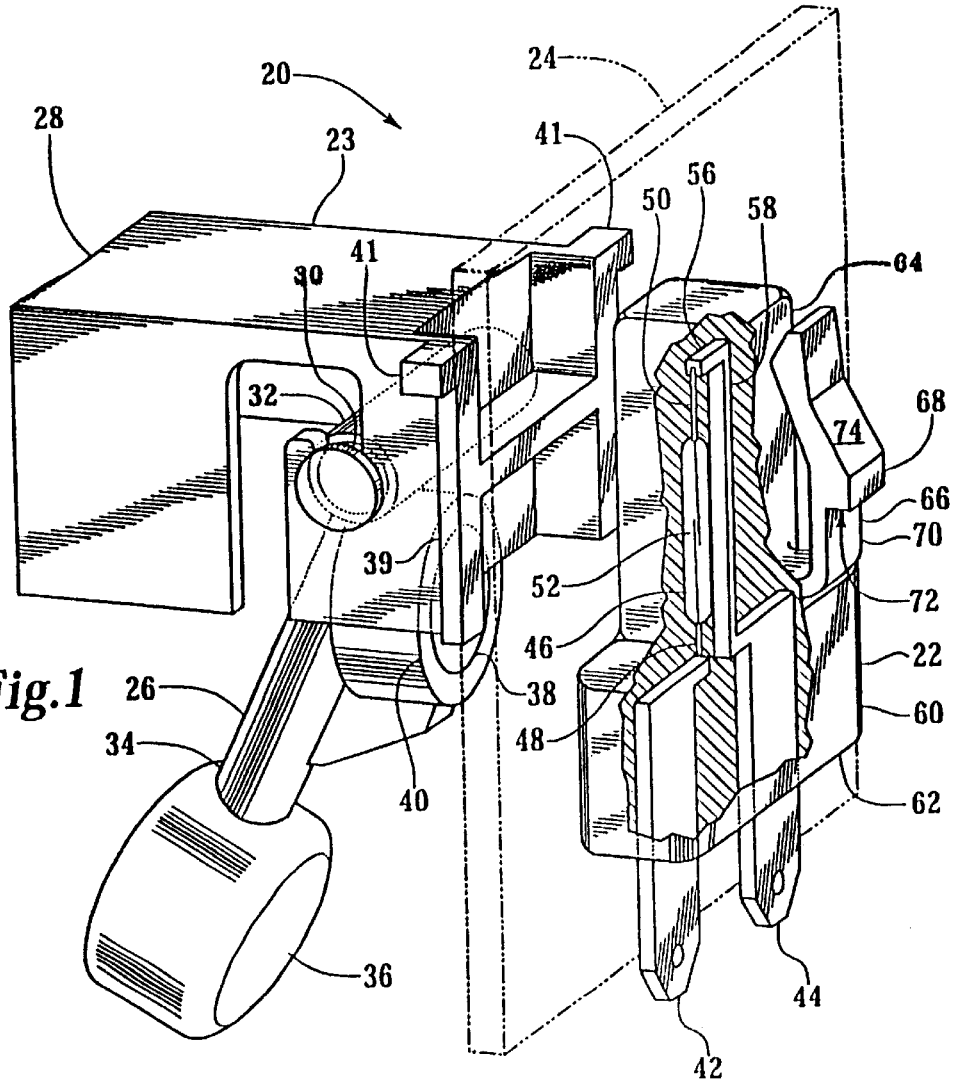
FIG. 1 is an isometric view of a reed switch module, magnet, and float forming the float sensor of this invention, partially broken away in section.
Figure 2:
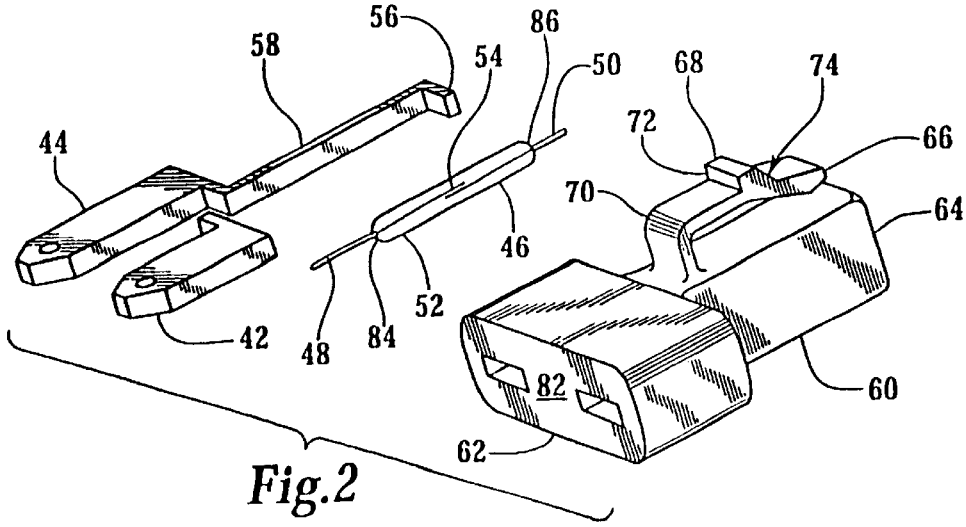
FIG. 2 is an exploded isometric view of the components forming the reed switch module of FIG. 1

Referring more particularly to FIGS. 1–6, wherein like numbers refer to similar parts, a float sensor 20 is shown in FIG. 1. The float sensor 20 has a reed switch module 22 and a float assembly 23. The float assembly 23 is located in a fluid reservoir (not shown) and is separated from the reed switch module 22 by an impermeable wall 24 shown schematically in FIG. 1. The float assembly 23 has a float arm 26 which is pivotally mounted by pivots 30 at a first end 32 of the arm to a float support structure 28. The opposite end 34 of the arm 26 supports a float bulb 36. The entire arm 26 which is constructed of the same buoyant material as the float bulb 36, together with the float bulb 36 responds to a rising liquid level by pivoting a magnet 38 away from the reed switch module 22. The magnet 38 is insert molded into the material forming the float arm 26. Portions of the float arm 26 form a cup structure 40 positioned on the arm 26 between the float bulb 36 and the pivot end 32 of the arm, the cup structure 40 partially surrounds the magnet 38. The magnet 38 is moved toward and away from the reed switch module 22 by the buoyancy of the arm 26 and float bulb 36 causing the arm 26 to pivot. The reed switch 46 within the module is caused to close or form a short circuit when the magnet 38 is closest to the reed switch module 22.

The float sensor 20 is typically employed in a salt brine reservoir formed by a structure (not shown) to which the float support structure 28 is mounted internal to the brine reservoir, and the reed switch module 22 is mounted external to the brine reservoir. The structure 28 performs the function of protecting the float 36 from salt that is poured down onto the structure 28 and into the brine reservoir (not shown). The support structure 28 has opposed rails 39 terminated by stops 41 which positions the support structure 28 on the reservoir structure (not shown).

The reed switch module 22 has a lead frame formed by a first blade 42 and a second blade 44. The blades 42, 44 form a standard 6.3 mm male plug. The male plug readily mates with the electronics of various appliances (not shown) which employ the float sensor 20. The reed switch module 22 contains a reed switch 46. The reed switch 46 has a first ferromagnetic reed 48, a second ferromagnetic reed 50, and a hermetic sealed glass capsule 52 which encloses the ends 54 of the reeds 48, 50. Contact of the reeds 48, 50 closes the reed switch 46. The first reed 48 is spot welded, or laser welded, or soldered to a tab which extends from the first blade 42. The second reed 50 is similarly welded or soldered to the end 56 of an arm 58 that extends from the second reed 50.

Figure 3:
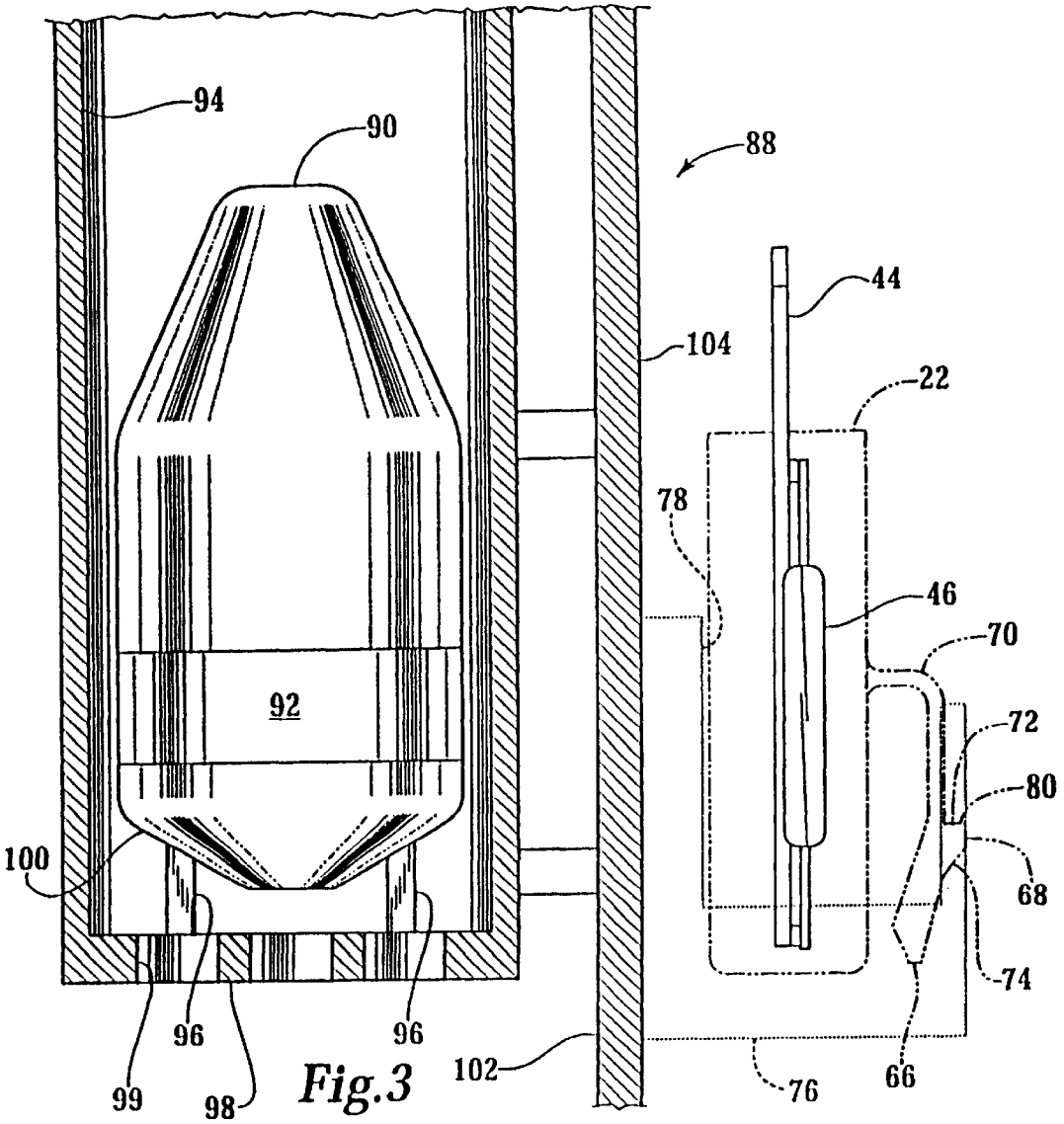
FIG. 3 is a cross-sectional view of an alternative float and magnet employed with the reed switch module of FIG. 1.
Figure 4:
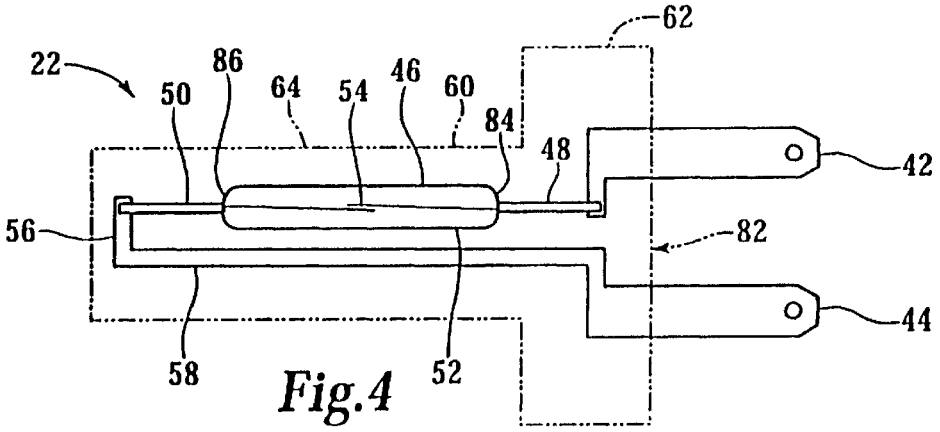
FIG. 4 is a cross-sectional view of the reed switch module of FIG. 1.
Figure 6:
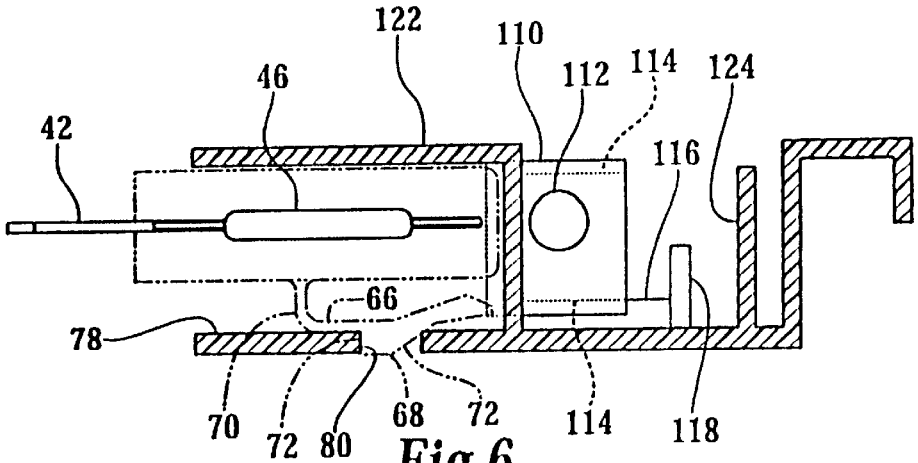
FIG. 6 is a cross-sectional view of the reservoir and reed switch module of FIG. 5 taken along line 6—6.

The plastic housing 60 which surrounds and encapsulates the reed switch 46 has a plug base 62, a reed switch surrounding extension 64, and a retaining clip 66. The clip 66 has a projection 68 mounted to a resilient clip body 70. The projection has a retaining face 72 which extends vertically from the resilient clip body, and an inclined ramp face 74 which is inclined relative to the vertical retaining face 72. The clip 66 is designed for assembly of the reed switch module 22 to a mounting structure 76 as shown in FIGS. 3 and 6. The ramp face 74 causes the clip body 70 to be depressed as the reed switch module is slid into a pocket 78. The retaining face 72 engages a wall 80 formed by a hole in the mounting structure 76 as shown in FIGS. 3 and 6.

For resistance to water, the reed switch module 22 is fabricated as an insert molded part formed of glass filled polyester. Reed switches are typically mounted to an electrical assembly such as a circuit board. Where a reed switch is being used as a switch in a float sensor application, particularly where moisture may be present, encapsulation is desirable to prevent corrosion and to prevent breakage of the reed switch. But insert molding a reed switch within a module presents problems.

An insert-molded part must be rapidly formed if it is to be economical. The insert molding process involves a cycle whereby a mold is opened, molded-in-assemblies are positioned, the mold is shot with molten, e.g. hot flowable, plastic under high pressure, the mold is opened, and the part is trimmed and thus finished. Rapid injection is important so that the mold cavity will be completely filled before significant cooling takes place. The mold or die is formed of metal. Plastic rushing into the mold can slam the reed switch against the mold sides breaking it. Rapid cooling of the injected plastic is important so that the part may be removed from the mold quickly, keeping down cycle times and thus the cost of parts. The capital cost of the molds and molding equipment forms a significant part of the overall cost, and therefore machine productivity is important.

Thus the economics and process limitations present problems when a reed switch is positioned within a mold to be molded-in to a part.

The reed switch module 22 is designed to overcome problems by supporting the reed switch from the relatively wide flat blades 42, 44 and injecting the plastic along and above and below the blades 42, 44 from the plug face 82 of the module 22. The inflowing plastic therefore first impacts the small end 84 of the reed switch 46 and, flowing parallel to the reed switch glass capsule 52, progressively engulfs the reed switch capsule 52, thereby progressively supporting the capsule 52 as the plastic begins to act on the inherently less rigid end 86. To position and handle the reed switch and blades 42, 44 the blades may be formed as a lead-frame wherein the blades are connected to a strip of metal from which they are cut after the module 22 is formed. The blades 42, 44 extend from the mold cavity used to form the module 22 and thus are not enclosed within the injected plastic.

The reed switch module 22 can be used with a variety of float assemblies to form float sensors. An alternative embodiment float sensor 88 employs a reed switch module 22 as shown in FIG. 3. The float 90 is a torpedo shaped insert molded part which incorporates a washer shaped magnet 92 positioned in a guide tube 94 which surrounds and constrains the motion of the float 90. The float 90 is formed with low density foam forming part of the plastic injected. The float 90 has a conical base 100 which rests on support blocks 96 which position the float 90 with respect to the reed switch module 22 and allow fluid to flow around the float 90 assuring that the float 90 is free to float within the tube to the tube bottom wall 98 which underlies the conical base 100. The tube bottom 98 has six holes 99 through which fluid such as salt brine flows as liquid in a reservoir 102 rises. An impervious wall 104 which forms a part of the fluid reservoir, separates the fluid reservoir from the reed switch module 22 and the structure to which it is mounted 76.

It should be understood that a float sensor employing a tube containing a float with an attached magnet, which interacts with an adjacent reed switch is conventional. The tube 94 is from an existing design. The design of the float 90 and its relation to the reed switch module 22 constitute the improvement.

The magnet 92 is of the high intensity type which can reliably actuate the reed switch 46 when spaced 10 to 12 millimeters from the edge of the magnet 92. The magnet 92, shown in FIG. 3 as forming a circumferential ring, will typically be nickel coated to protect it from the environment. When the float 90 is seated on the support blocks 96 the reed switch is in the activated state.

Figure 5:
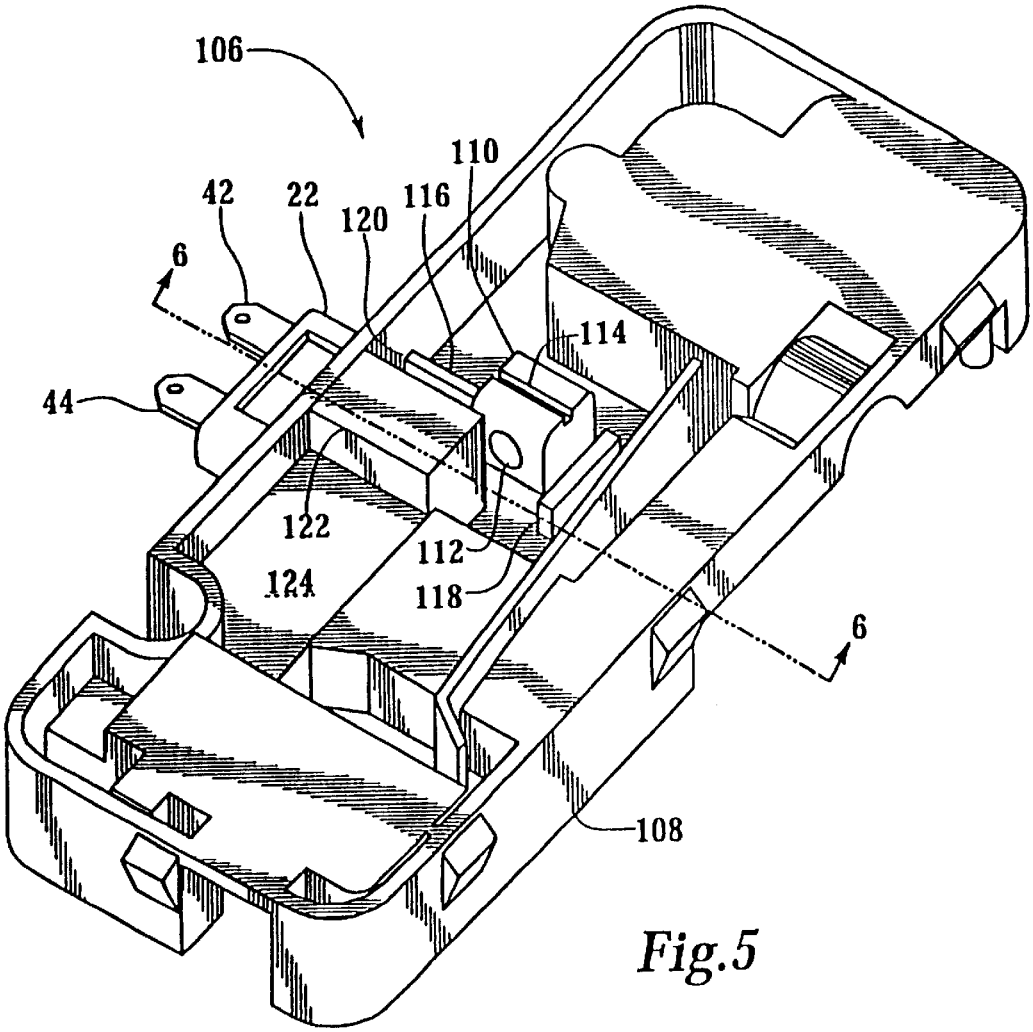
FIG. 5 is an isometric view of one-half of a fluid reservoir employing another alternative float sensor and magnet employed with the reed switch module of FIG. 1.

A further embodiment float sensor 106 which incorporates the reed switch module 22 is shown in FIGS. 5 and 6. One half of a plastic reservoir body 108 used to hold a rinse aid for a dishwasher is illustrated. A rinse aid is a liquid which prevents spotting of dishes and glasses by reducing surface tension or otherwise modified water quality. A float 110 is positioned within the reservoir 108. A simple cylindrical magnet 112 is molded in place within the float 110. The float 110 has two opposed grooves 114. The lower of the grooves 114 is shown in FIG. 5 and FIG. 6 riding on a lower guide rail 116 which is one of a pair of opposed rails. The other rail would be positioned on the other half of the reservoir body, not shown. The float 110 is thus constrained to float between a lower stop 118 and the upper wall 120 of the plastic reservoir 108.

A portion 122 of the plastic reservoir body 108 separates the interior 124 on the reservoir formed by the plastic body 108 from the reed switch module 22. The presence of sufficient rinse aid causes the magnet 112 to move up against the upper wall 120 which closes the reed switch, the output of which can be used to indicate the presence of rinse aid.

An alternative method of forming the reed switch module 22 is to form a shell having the exterior dimensions allowed the module as shown in FIG. 1 and to position the blades 42, 44 with the reed switch mounted therein within the shell. The shell is then filled with an epoxy, polyurethane or other moldable plastic.

It should be understood that each float employs a high intensity magnet which may be solid metal or may be particles embedded in plastic. And each magnet is thus capable of causing a reed switch placed 10–12 mm away to close.

It should be understood that where a float is described and illustrated, the float could be larger to achieve greater buoyancy force to move the magnet.

I claim:

1. A float sensor employing a reed switch comprising:

a structure forming a reservoir for holding a selected liquid, the structure having an impervious wall for separating the selected liquid from a portion of the structure;

a reed switch molded within a solid body of glass filled polyester;

two leads extending from the solid body of plastic, the leads connected to the reed switch within the solid body of glass filled polyester so that when the reed switch is closed a short circuit is formed between the leads;

a portion of the body of glass filled polyester forming a means for positioning and retaining the body on a structure, so the body is spaced from the reservoir by the impervious wall;

a magnet mounted to a float positioned within the reservoir, and a float support structure, having two opposed rails which position the float support structure on the structure forming a reserve; and an arm mounted to the float support structure at a second end, and having a first end attached to the float, wherein the magnet is positioned between the float and the second end, the arm being positioned so that when the selected liquid is not present, the magnet is adjacent the impervious wall, and when the selected liquid is present, the float lifts the magnet away from the impervious wall so that a change in the selected liquid level within the reservoir will move the magnet into and out of actuation range of the reed switch.

2. The float sensor of claim 1, wherein the opposed rails of the support structure are terminated by stops.

3. The float sensor of claim 1, wherein the entire arm and the float is constructed of the same buoyant material.

4. The float sensor of claim 1, wherein the float support structure overlies the arm so as to perform the function of protecting the float from salt which is poured down onto the float support structure.

5. A float sensor employing a reed switch comprising:

a structure forming a reservoir for holding a selected liquid, the structure having an impervious wall for separating the selected liquid from a portion of the structure;

a reed switch molded within a solid body of plastic;

two leads extending from the solid body of plastic, the leads connected to the reed switch within the solid body of plastic so that when the reed switch is closed a short circuit is formed between the leads;

a portion of the solid plastic body forming a means for positioning and retaining the solid plastic body on the structure, so the solid plastic body is spaced from the reservoir by the impervious wall;

a torpedo shaped insert molded float with a conical base which incorporates a nickel plated washer shaped magnet, the float formed with low density foam forming part of the plastic injected to form the float, and means for constraining the motion of the float and the attached magnet so that a change in the selected liquid level within the reservoir will move the magnet into and out of actuation range of the reed switch a guide tube mounted to the structure and positioned within the fluid reservoir, the guide tube having a bottom wall, wherein portions of the bottom wall form an opening for the passage of the selected liquid into the guide tube, the float being captured within the guide tube and movable within the guide tube in response to the selected liquid filling the tube through the opening, the float washer shaped magnet being of high intensity and being capable of closing a reed switch located approximately 10–12 millimeters away.

6. A float sensor in a reservoir for holding rinse aid for a dishwasher comprising:

a first half structure and a second half structure joined to form a structure forming the reservoir for holding rinse aid, the structure having an impervious wall;

a reed switch molded within a solid body of plastic;

two leads extending from the solid body of plastic, the leads connected to the reed switch within the solid body of plastic so that when the reed switch is closed a short circuit is formed between the leads;

a portion of the solid plastic body forming a means for positioning and retaining the solid plastic body on the structure, so the solid plastic body is spaced from the reservoir by the impervious wall;

a magnet mounted to a float positioned within the reservoir, the float having a first and a second opposed grooves, the first of the grooves riding on a first guide rail which is on the first half structure, the second of the grooves riding on a second guide rail which is on the second half structure;

so that a change in the rinse aid level within the reservoir will move the magnet into and out of actuation range of the reed switch; and wherein the structure constrains the magnet mounted to the float to move between a first stop and a second stop, and wherein the presence of the rinse aid liquid within the fluid reservoir causes the magnet to move between the first stop towards the second stop and into activation range of the reed switch.

7. A float sensor for rinse aid dispensing within a dishwasher comprising:

a structure forming a reservoir for holding a rinse aid, the structure having an impervious wall for separating the selected liquid from a portion of the structure;

a reed switch molded within a solid body of plastic;

two leads extending from the solid body of plastic, the leads connected to the reed switch within the solid plastic body so that when the reed switch is closed a short circuit is formed between the leads; and a portion of the solid plastic body forming a means for positioning, and retaining the solid plastic body on a structure, so the solid plastic body is spaced from the reservoir by the impervious wall; and a magnet mounted to a float positioned within the reservoir, at least two guide rails, one guide rail mounted to each of two opposed halves of the structure forming the fluid reservoir, the float having a pair of grooves engaged with the guide rails, the structure constraining the magnet mounted to the float to move between a first stop and a second stop, wherein the presence of the rinse aid within the fluid reservoir causes the magnet to move between the first stop towards the second stop and into activation range of the reed switch.

8. A float sensor for monitoring the liquid level in a brine tank, comprising:

a structure forming a reservoir for holding brine, the structure having an impervious wall for separating the brine from a portion of the structure;

a reed switch molded within a solid body of plastic;

two leads extending from the solid body of plastic, the leads connected to the reed switch within the solid plastic body so that when the reed switch is closed a short circuit is formed between the leads;

a portion of the solid plastic body forming a means for positioning, and retaining the solid plastic body on a structure, so the solid plastic body is spaced from the reservoir by the impervious wall;

a magnet mounted to a float positioned within the reservoir, and a float support structure, having mounting structure which positions the float support structure on the structure forming a reservoir;

the float attached to a first end of an arm, the arm pivotally mounted to the float support structure at a second end, the magnet mounted between the float and the second end which is pivotally mounted, the arm positioned so that when brine is not present, the magnet is adjacent the reed switch module, and when the brine is present the float lifts the magnet away from the reed switch module, wherein the float support structure overlies the arm so as to perform the function of protecting the float from salt which is poured down onto the float support structure.

9. A float sensor for monitoring the liquid level in a brine tank:

a structure forming a reservoir for holding brine, the structure having an impervious wall for separating the brine from a portion of the structure;

a reed switch molded within a solid glass filled polyester body of plastic;

two leads extending from the solid glass filled polyester body of plastic, the leads connected to the reed switch within the solid plastic body so that when the reed switch is closed a short circuit is formed between the leads;

portions of the solid glass filled polyester plastic body forming a means for positioning and retaining the solid plastic body on the structure, to space the solid plastic body from the reservoir by the impervious wall;

a torpedo shaped insert molded float with a conical base which incorporates a washer shaped magnet, the float formed with low density foam forming part of the plastic injected to form the float;

a guide tube mounted to the structure, and positioned within the fluid reservoir, the guide tube having a bottom wall; and portions of the bottom wall forming an opening for the passage of brine into the guide tube, wherein the float is captured within the guide tube and is movable within the guide tube in response to the brine filling the tube through the opening, the float having a high intensity magnet capable of closing a reed switch located approximately 10–12 millimeters away.

* * * * *